US005230353A

United States Patent [19]

Heitmann

[11] Patent Number: 5,230,353

[45] Date of Patent: Jul. 27, 1993

[54] METHOD OF AND APPARATUS FOR SIMULTANEOUSLY PRODUCING TWO CONTINUOUS TOBACCO STREAMS

[75] Inventor: Uwe Heitmann, Hamburg, Fed. Rep. of Germany

[73] Assignee: Körber AG, Hamburg, Fed. Rep. of Germany

[21] Appl. No.: 866,838

[22] Filed: Apr. 10, 1992

[30] Foreign Application Priority Data

Apr. 30, 1991 [DE] Fed. Rep. of Germany ..... 4114104

[51] Int. Cl.[5] ..... A24C 5/14

[52] U.S. Cl. ..... 131/84.1; 131/84.3

[58] Field of Search ..... 131/84.1, 84.3, 108, 131/110

[56] References Cited

U.S. PATENT DOCUMENTS

| | | | |
|---|---|---|---|
| 4,185,644 | 1/1980 | Heitmann . | |
| 4,610,260 | 9/1986 | Heitmann | 131/84.3 |
| 4,889,138 | 12/1989 | Heitmann et al. | 131/84.1 |
| 5,009,238 | 4/1991 | Heitmann | 131/108 |
| 5,022,415 | 6/1991 | Belvederi et al. | 131/84.1 |
| 5,072,741 | 12/1991 | Heitmann | 131/84.1 |

*Primary Examiner*—V. Millin
*Assistant Examiner*—J. L. Doyle
*Attorney, Agent, or Firm*—Peter K. Kontler

[57] ABSTRACT

Two tobacco streams are made simultaneously by feeding a main flow of tobacco particles upwardly through a suction duct which terminates beneath two parallel foraminous belt conveyors. The sidewalls of the duct have alternating wedge-like ramps which divide the ascending main flow into plural first and second flows in such a way that the first flows advance from one of the sidewalls toward the other sidewall and the second flows advance from the other sidewall toward the one sidewall. In addition, the sidewalls and their ramps define several passageways for unimpeded ascent of numerous relatively small third flows of tobacco particles directly against the convex underside of a partition which is located in the duct between the two conveyors. The partition breaks up each third flow into two equal partial flows and causes each partial flow to rise toward a different foraminous conveyor. This ensures the division of the main flow into two equal streams without any classification and/or other undesirable influencing of tobacco particles.

16 Claims, 2 Drawing Sheets

Fig. 1
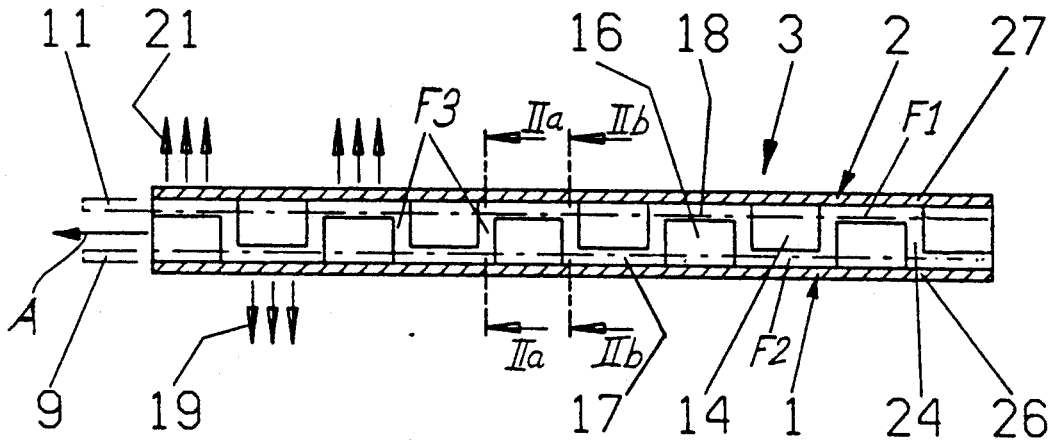
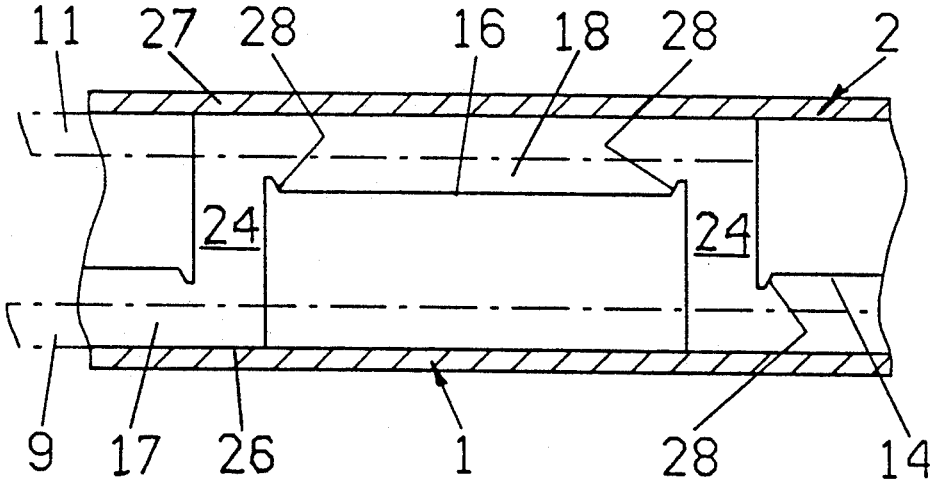
Fig.3

METHOD OF AND APPARATUS FOR SIMULTANEOUSLY PRODUCING TWO CONTINUOUS TOBACCO STREAMS

BACKGROUND OF THE INVENTION

The invention relates to improvements in methods of and in apparatus for making continuous streams of fibrous material, and more particularly to improvements in methods of and in apparatus for simultaneously producing two continuous streams of comminuted particles of tobacco and/or other smokable material.

It is already known to simultaneously make two continuous tobacco streams in a so-called twin cigarette rod making machine wherein each of the two streams is converted into the filler of a discrete cigarette rod. Each rod is then severed to yield a succession of plain cigarettes of unit length or multiple unit length. Similar procedure can be resorted to for simultaneous making of two continuous cigarillo, cigar or cheroot rods. Reference may be had, for example, to commonly owned U.S. Pat. No. 5,009,238 granted Apr. 23, 1991 for "Apparatus for supplying fibrous material to machines for simultaneously producing a plurality of cigarette rods" and to commonly owned U.S. Pat. No. 5,072,741 granted Dec. 17, 1991 for "Method of and apparatus for making plural tobacco filler streams". The disclosures of these patents are incorporated herein by reference. The patented apparatus employ means for dividing a relatively wide main flow of tobacco particles into two narrower flows each of which is directed against the underside of the lower reach of a foraminous belt conveyor to form thereon a stream which is then ready for trimming (involving removal of surplus tobacco particles) and conversion into a rod-like filler.

It is not only desirable but indeed necessary to ensure that the distribution of various types of tobacco particles in, as well as all other characteristics of, one of the streams match the characteristics of the other stream. This ensures that the quality of rod-shaped articles of the tobacco processing industry which are obtained as a result of subdivision of one of the cigarette rods matches the quality of articles which are obtained as a result of subdivision of the other cigarette rod. Such uniformity of characteristics of the two simultaneously produced tobacco streams can be achieved only by accurately controlling the treatment of tobacco particles in each and every part of a so-called distributor (also known as hopper) which serves to convert a mass of tobacco particles into the two narrower flows and to direct the narrower flows toward the foraminous conveyors in order to build two discrete tobacco streams. The distributor comprises a duct which is located immediately upstream of the foraminous conveyors and is intended to direct each of the two narrower flows toward the underside of the lower reach of the respective conveyor. As a rule, the duct defines a path for the upward flow of tobacco particles forming the two narrower flows. Such path is narrow, as measured transversely of the foraminous conveyors, but is rather wide in the direction of advancement of tobacco streams with the respective foraminous conveyors. This ensures the establishment of two relatively long stream building zones wherein successive increments of the two ascending narrower flows of tobacco particles are converted into successive increments of the respective streams. Tobacco particles of the two narrower flows which enter the lower end of the duct to ascend toward the respective foraminous conveyors exhibit the tendency to mingle, and this can affect the quality of the two streams in a sense that the composition of one of these streams deviates from the composition of the other stream. In fact, it has been observed that the rather thoroughly intermixed particles of each of the two narrower flows entering the duct tend to undergo a classification according to size and/or shape which adversely affects the quality of rod-like fillers of the two tobacco rods. Some classification of particles according to size and/or shape can take place within as well as at the inlet to the aforementioned duct. Any, even minute, classification within the duct will adversely affect the quality, such as the density, the so-called draw resistance, the weight and/or other important characteristics of the rod-shaped articles which are obtained from the two streams, namely which are obtained by trimming, densifying, draping and subdividing the streams downstream of the stream building stations.

OBJECTS OF THE INVENTION

An object of the invention is to provide a novel and improved method of simultaneously forming two continuous streams of comminuted smokable material in such a way that all important characteristics of one of the two streams match the corresponding characteristics of the other stream.

Another object of the invention is to provide a novel and improved method of enhancing the distribution of various constituents of two simultaneously produced streams of comminuted smokable material.

A further object of the invention is to provide a novel and improved method of ensuring that the quantity of smokable material in successive increments of one stream matches the quantity of smokable material in the other stream.

An additional object of the invention is to provide a novel and improved method of ensuring that the composition of smokable material in one of the streams will match the composition of smokable material in the other stream.

Still another object of the invention is to provide a novel and improved method of manipulating tobacco particles in a duct which serves to convey such particles into the range of plural stream building conveyors.

A further object of the invention is to control, in a novel and improved way, the direction of advancement of tobacco particles in the duct of a distributor for use in a twin cigarette rod maker.

Another object of the invention is to provide a novel and improved apparatus for the practice of the above outlined method.

An additional object of the invention is to provide the apparatus with novel and improved means for breaking up a main flow of tobacco particles on their way toward plural stream building conveyors in a machine for making plural continuous tobacco-containing streams.

Still another object of the invention is to provide a novel and improved duct for use in the above outlined apparatus.

A further object of the invention is to provide the apparatus with novel and improved means for controlling the direction of flow of tobacco particles toward plural foraminous conveyors.

An additional object of the invention is to provide an apparatus which can reliably control and/or enhance the desirable distribution and/or other characteristics of a flowing mass of smokable material on its way toward plural stream building zones.

Another object of the invention is to provide a twin cigarette rod making machine which embodies the above outlined apparatus.

SUMMARY OF THE INVENTION

One feature of the present invention resides in the provision of a method of simultaneously making two continuous tobacco streams which advance along first and second elongated paths in a first direction. The method comprises the steps of conveying a main flow of tobacco particles (e.g., a mixture of shredded tobacco leaf laminae and comminuted tobacco ribs) in a second direction transversely of the first direction along a third path which is wide in the first direction, dividing the main flow into a plurality of narrower first flows, a plurality of narrower second flows which alternate with the first flows and at least one third flow, directing the first flows into the second path, directing the second flows into the first path, breaking up the at least one third flow into first and second partial flows, directing the first partial flow into the first path, and directing the second partial flow into the second path.

The conveying step is preferably carried out by pneumatic means. It is presently preferred to convey the main flow by suction upwardly and along the third path.

The method can further comprise the step of aspirating the at least one third flow toward but short of the first and second paths. The step of breaking up the at least one third flow can comprise dividing the at least one third flow into the two partial flows (which are preferably identical or nearly identical) within the third path close to the first and second paths.

The method can further comprise the steps of merging the first partial flow with the second flows not later than in the first path, and merging the second partial flow with the first flows not later than in the second path.

Another feature of the invention resides in the provision of an apparatus for simultaneously making two continuous tobacco streams. The improved apparatus comprises two conveyors (e.g., endless foraminous belt conveyors) which define first and second elongated paths for transport of the two streams in a first direction, and a duct which defines a third path for advancement of a main tobacco flow along a third path in a second direction transversely of the first direction. The duct has two preferably parallel sidewalls which flank the third path in the first direction, and the apparatus further comprises means (e.g., a suction chamber adjacent the foraminous conveyors or other suitable means for attracting the main flow toward the conveyors) for conveying the main flow in the second direction, means for dividing the main flow into first and second flows and into at least one third flow and for diverting the first and second flows into the second and first paths, respectively, and means for breaking up the at least one third flow into first and second partial flows and for directing the first and second partial flows into the first and second paths, respectively.

The dividing means can comprise first ramps provided on one of the sidewalls and sloping in the second direction toward the other sidewall, and second ramps provided on the other sidewall and sloping in the second direction toward the one sidewall. The first ramps preferably alternate with the second ramps in the first direction.

The means for breaking up the at least one third flow preferably includes a partition which is disposed between the two conveyors intermediate the sidewalls and extends in the first direction. The sidewalls include confronting portions which flank several portions of the third path and define substantially straight passages for advancement of a plurality of third flows toward and against the partition. The combined width of the first ramps in the first direction is preferably a multiple of the combined width of the aforementioned portions of the one sidewall, and the combined width of the second ramps in the first direction is preferably a multiple of the combined width of the aforementioned portions of the other sidewall.

The partition is preferably provided with a convex face which confronts the ramps by facing counter to the direction of advancement of the first, second and third flows in the duct.

At least one of the two sidewalls is preferably provided with air discharging outlet ports at the partition. Such ports can be said to constitute aspiration openings which draw the first and second flows toward the inner sides of the other sidewall and the one sidewall, respectively. The arrangement is preferably such that each of the two sidewalls has air discharging outlet ports. The first ramps slope toward the outlet ports of the other sidewall, and the second ramps slope toward the outlet ports of the one sidewall. The outlet ports of the one sidewall can be located between the partition and the second ramps, and the outlet ports of the other sidewall can be located between the partition and the first ramps.

At least some of the ramps can be provided with tobacco guiding portions which extend in the second direction.

The novel features which are considered as characteristic of the invention are set forth in particular in the appended claims. The improved apparatus itself, however, both as to its construction and its mode of operation to practice the improved method, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a horizontal sectional view of the duct in an apparatus which embodies one form of the invention, the section being taken in the direction of arrows as seen from the line I—I in FIG. 2*a;*

FIG. 3 is an enlarged view of a detail in FIG. 1.

DESCRIPTION OF PREFERRED EMBODIMENTS

Figure 2A:
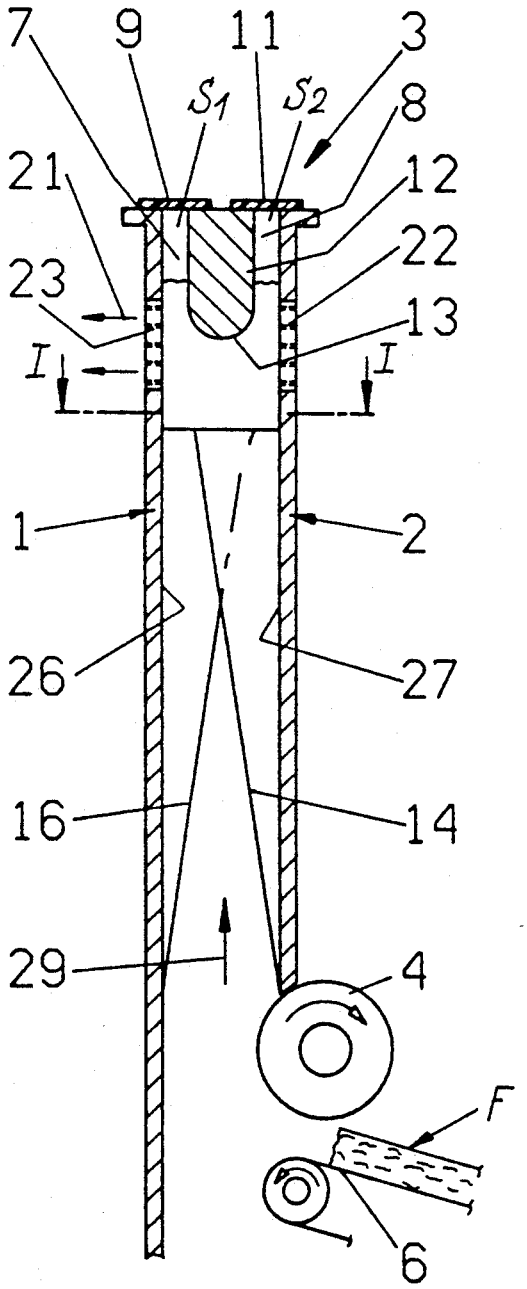
FIG. 2*a* is an enlarged sectional view of the apparatus of FIG. 1, substantially as seen in the direction of arrows from the line II*a*—II*a* in FIG. 1.

The apparatus which is shown in the drawing forms part of a so-called distributor or hopper, e.g., a distributor of the type described and shown in the aforementioned commonly owned U.S. Pat. No. 5,009,238. Similar distributors, but for use in machines for making a single tobacco rod, are described and shown in commonly owned U.S. Pat. No. 4,185,644 granted Jan. 29, 1980 for "Distributor for cigarette makers or the like" and in commonly owned U.S. Pat. No. 4,610,260 granted Sep. 9, 1986 for "Apparatus for forming a tobacco stream". The disclosures of these two patents are also incorporated herein by reference.

The improved apparatus comprises a relatively thin but wide duct 3 having two spaced parallel sidewalls 1, 2. The top portion of the (third) path which is defined by the duct 3 accommodates an elongated strip-shaped partition 12 serving as a means for breaking up several relatively small (third) flows F3 of tobacco particles into pairs of partial flows and for directing the two partial flows (which are preferably identical) into elongated parallel first and second paths 7, 8 beneath the undersides of lower reaches of two endless foraminous belt conveyors 9, 11. These conveyors can be made of a textile or other suitable material and are disposed beneath a common suction chamber or beneath two discrete suction chambers (reference may be had to the aforementioned commonly owned U.S. patents) serving as a means for conveying a relatively large main flow F of tobacco particles in the direction of arrow 29, namely from the lower or intake end of the duct 3 toward the paths 7, 8 for two continuous tobacco streams S1 and S2, respectively. The streams S1, S2 are thereupon trimmed, condensed into rod-like fillers, draped into webs of cigarette paper or other suitable wrapping material to form rods, and severed by discrete subdividing devices (known as cutoffs) to yield two files of plain cigarettes of unit length or multiple unit length.

The duct 3 is located in a vertical plane and the illustrated lower reaches of the foraminous conveyors are or can be substantially horizontal. The direction of advancement of tobacco streams S1, S2 with the respective conveyors 9, 11 is indicated by an arrow A, and the aforementioned arrow 29 indicates the direction of advancement of tobacco particles (such as shreds of tobacco leaf laminae, comminuted tobacco ribs, particles of reconstituted tobacco and/or particles of substitute tobacco). It will be noted that the direction of advancement of tobacco particles in the duct 3 is transversely of the direction of advancement of the streams S1, S2 with the respective foraminous conveyors 9, 11, and that the third path which is defined by the duct 3 is wide as seen in the direction of the arrow A but narrow as considered transversely of the lower reaches of the conveyors 9 and 11.

The means for delivering the main flow F into the inlet at the lower end of the duct 3 includes an endless belt conveyor 6 which cooperates with a roller 4 to direct successive increments of the main flow into the current of ascending air which is drawn by the suction chamber or chambers above the lower reaches of the conveyors 9 and 11.

The inlet at the lower end of the duct 3 is located above a secondary or auxiliary classifying device (not shown) which accepts relatively heavy tobacco particles, i.e., those particles which are too heavy to rise with the current of air flowing in the direction of arrow 29. The classifying device can be of the type described in U.S. Pat. No. 5,009,238.

Figure 2B:
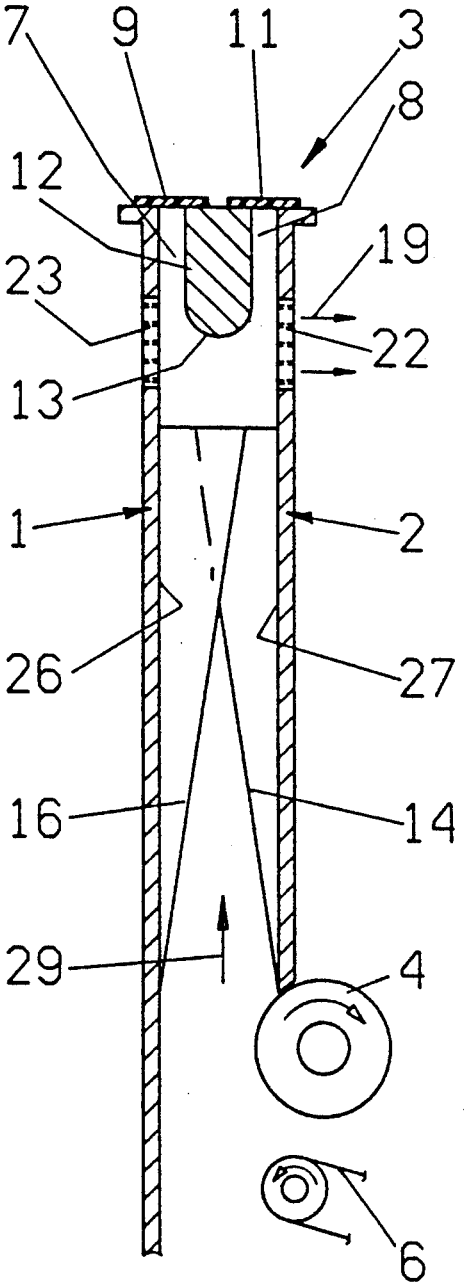
FIG. 2*b* is a similar enlarged sectional view substantially as seen in the direction of arrows from the line II*b*—II*b* in FIG. 1.

In FIGS. 2*a* and 2*b*, the illustrated lower reaches of the conveyors 9, 11 are driven to transport the respective streams S1, S2 in a direction (arrow A in FIG. 1) at right angles to the plane of the drawing. In FIG. 1, the conveyors 9 and 11 are located in front of the plane of the drawing. The underside of the partition 12 is a preferably convex face 13 which has two identical mirror symmetrical halves and serves to break up each third flow F3 into two equal partial flows, to direct one of the partial flows into the path 7, and to direct the other partial flow into the path 8. The partition 12 preferably extends the full width of the path which is defined by the duct 3 and is flanked by the two sidewalls 1 and 2. The front and rear ends of the duct 3 (as seen in and counter to the direction of the arrow A) may but need not be closed.

The inner side of the sidewall 1 is provided with a first half of a means for dividing the wide main flow F into a plurality of narrower first flows F1, into a plurality of narrower second flows F2, and into a plurality of third flows F3. The flow dividing means includes a set of spaced apart parallel wedge-like ramps 16 which slope from the inlet of the duct 3 toward the path 8 in a direction from the inner side of the sidewall 1 toward the inner side of the sidewall 2, and a set of spaced apart parallel wedge-like ramps 14 which slope from the inlet of the duct 3 toward the path 7 in a direction from the inner side of the sidewall 2 toward the inner side of the sidewall 1. As can be seen in FIGS. 1 and 3, the ramps 14 alternate with the ramps 16 (as seen in the direction of arrow A), and each pair of neighboring ramps 14, 16 defines a relatively narrow portion 24 of the (third) path which is defined by the duct 3. Such narrow portions 24 of the third path constitute passageways for advancement of third flows F3 from the inlet of the duct 3 toward and against the convex face 13 of the partition 12. Each passage or path portion 24 is disposed between a relatively narrow portion 26 of the sidewall 1 and a confronting relatively narrow portion 27 of the sidewall 2. The path portions 18 along the upwardly sloping sides of the ramps 16 serve to guide first flows F1 toward and into the second path 8, and the path portions 17 along the upwardly sloping sides of the ramps 14 serve to direct second flows F2 toward and into the first path 7. The path portions 17, 18, 24 jointly establish a meandering space for upward advancement of the flows F1, F2 and F3 from the inlet of the duct 3 toward the upper side of the duct, i.e., the flows F1 enter the second path 8, the flows F2 enter the first path 7, and the flows F3 impinge upon and are halved by the convex face 13 of the partition 12. The path portions 17 and 18 narrow in a direction from the inlet of the duct 3 toward the respective paths 8 and 7. On the other hand, the cross-sectional area of each path portion or passage 24 is constant all the way from the inlet of the duct 3 to the partition 12.

The sidewall 1 is formed with a set of ports 23 at a level above the ramps 14, 16 but beneath the uppermost portion of the sidewall 1 (generally at the level of the face 13), and similar ports 22 are provided in the sidewall 2, again at the general level of the convex face 13 of the partition 12. The purpose of such ports is to permit escape of surplus air which is being drawn by the suction chamber or chambers above the lower reaches of the foraminous conveyors 9 and 11. In addition, streamlets of air which leave the duct 3 through the ports 23 in the direction of arrows 21 serve to attract the flows F2 toward the inner side of the sidewall 1 and to thus ensure that such flows enter the first path 7. Analogously, streamlets of air leaving the duct 3 through the ports 22 in the direction of arrows 19 attract the upper ends of the flows F1 and thus ensure entry of such flows into the second path 8.

FIG. 1 shows that the combined width of the ramps 16 (as measured in the direction of arrow A) is a multiple of the combined width of portions 26 of the sidewall 1. Analogously, the combined width of the ramps 14 (again as measured in the direction of arrow A) is a multiple of the combined width of portions 27 of the sidewall 2. Thus, the width of each path portion 17 or 18 can be a multiple of the width of a passage 24 (as measured in the direction of arrow A). On the other hand, each passage 24 extends all the way from the inner side of the sidewall 1 to the inner side of the sidewall 2.

FIG. 3 shows that the ramps 14 and 16 can be provided with tobacco guiding portions 28 which extend from the inlet of the duct 3 toward the respective first and second paths 7 and 8. The purpose of such guide portions is to reduce the likelihood of slippage or shifting of the flows F1 and F2 in or counter to the direction of arrow A. This contributes to the effectiveness of the duct 3 as a means for preventing classification of tobacco particles according to size, weight and/or in any other undesirable manner.

The operation is as follows:

The conveyor 6 delivers a main flow F of thoroughly intermixed tobacco particles into the inlet at the lower end of the duct 3. Entry of successive increments of the main flow F into the ascending current of air (arrow 29) is assisted by the roller 6. Heavier particles (if any) descend from the duct 3 into the aforementioned secondary classifier and are evacuated from the distributor. The major part of the ascending main flow F is divided by the two sets of ramps to form the first and second flows F1 and F2 which rise along the upwardly sloping sides of the ramps 16, 14 and ultimately enter the second and first paths 8, 7, respectively. The surplus of the air current leaves the duct 3 through the ports 22 and 23 to thereby assist in directing the flows F2 into the path 7 and in directing the flows F1 into the path 8.

The flows F1 and F2 jointly constitute somewhat less than the entire main flow F. The remnant of the main flow F is divided into numerous third flows F3 which ascend and are accelerated in the respective passages 24 practically without obstruction all the way to the partition 12 to be halved by the convex face 13. The thus obtained partial flows are directed (by the respective halves of the convex face 13 and by the streamlets of air flowing in the directions of arrows 19 and 21) into the adjacent first and second paths 7 and 8. This ensures that each of the two tobacco streams S1, S2 receives exactly one-half of the main flow F. One-half of each third flow F3 merges into the flows F1 at or close to the second path 8, and the other half of each third flow F3 merges into the flows F2 at or close to the first path 7.

It will be noted that streamlets of air which leave the duct 3 in the directions of arrows 19 and 21 not only assist the flows F1, F2 in finding their way into the respective paths 8 and 7, but such streamlets also assist the halves of the third flows F3 in finding their way into the respective paths 7 and 8.

It has been found that the improved apparatus is capable of producing or forming two streams S1 and S2 wherein the distribution of tobacco particles, the quantities of tobacco particles and the composition of successive increments are the same. At the very least, the just outlined characteristics of the two streams are much closer to being identical than when two tobacco streams are formed in accordance with heretofore known proposals.

An important advantage of the ramps 14 and 16 is that they control the trajectories of the heavier, lighter, larger and/or smaller tobacco particles in a highly satisfactory manner. Thus, even the heaviest tobacco particles are compelled to follow a path portion 17, 18 or 24 and are less likely to migrate from the flows F1 into the flows F2 and/or F3, from the flows F2 into the flows F1 and/or F3, or from the flows F3 into the flows F1 and/or F2.

The convex face 13 of the partition 12 has been found to ensure reliable halving of each third flow F3 to thus contribute to uniform division of the main flow F into the two streams S1, S2.

The ramps 14 and 16 exhibit the advantage that they convey the respective flows F2 and F1 in the desired directions irrespective of the exact composition of such flows. Thus, the composition of those portions of the main flow F which form the flows F1 and F2 does not change during advancement of the flows F1 and F2 into the paths 8 and 7, respectively. Consequently, and since the distributor which supplies the main flow F is designed to ensure that the composition of each increment of the flow F is satisfactory for breaking up into two equal streams S1 and S2, the composition need not change during advancement of successive increments of the flow F from the conveyor 4 partially into the path 7 and partially into the path 8. Moreover, the ramps 14 and 16 are designed to actually aim or propel the respective flows F2 and F1 into the range of the corresponding conveyors 9 and 11.

The path portions or passages 24 exhibit the advantage that they greatly reduce the likelihood of certain tobacco particles being caught on their way from the conveyor 4 toward the conveyors 9 and 11 so that the likelihood of clogging of the duct 3 is very remote.

The feature that the combined width of the ramps 14 exceeds the combined width of the sidewall portions 27, and that the combined width of the ramps 16 exceeds the combined width of the sidewall portions 26 also contributes to more predictable halving of the main flow F into the streams S1 and S2.

The quantity of tobacco forming the third flows F3 is smaller or much smaller than the combined quantity of tobacco forming the flows F1 and F2. This is desirable because it is much simpler to break up the relatively small third flows F3 into pairs of identical partial flows which are then directed into the paths 7 and 8 as a result of impingement upon and sliding along the respective halves of the convex face 13 of the partition 12.

The tobacco guiding portions 28 constitute a desirable and advantageous but optional feature of the ramps 14 and 16. Such guiding portions can be omitted if the upwardly sloping sides of the ramps 14 and 16 are at least slightly concave. As shown, the tobacco guiding portions 28 simply constitute relatively small rails or ledges which extend from the ramps 16 toward the sidewall 2 and from the ramps 14 toward the sidewall 1. If desired, the upwardly sloping sides of the ramps 14, 16 can be provided with additional tobacco guiding portions between the illustrated pairs of guiding portions 28. All that counts is to design the ramps 14 and 16 in such a way that the flows F1 and F2 are unlikely to advance in or counter to the direction of arrow A and to merge into the adjacent flows F3 or vice versa.

The streams S1 and S2 can be converted into continuous tobacco rods which yield identical plain cigarettes, cigars, cigarillos or other rod-shaped articles of the tobacco processing industry. This ensures that the draw resistance (i.e., resistance to the flow of tobacco smoke), the hardness and/or other desirable characteristics of any rod-shaped article obtained from one tobacco rod match the corresponding desirable characteristics of each article which is obtained from the other tobacco rod.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of simultaneously making two continuous tobacco streams which advance along first and second elongated paths in a first direction, comprising the steps of conveying a main flow of tobacco particles in a second direction transversely of said first direction along a third path which is wide in said first direction; dividing said main flow into a plurality of narrower first flows, a plurality of narrower second flows which alternate with said first flows in said first direction and at least one third flow; directing said first flows into said second path; directing said second flows into said first path; breaking up said at least one third flow into first and second partial flows; directing said first partial flow into said first path; and directing said second partial flow into said second path.

2. The method of claim 1, wherein said conveying step includes drawing the main flow by suction upwardly along said third path.

3. The method of claim 2, further comprising the step of aspirating said at least one third flow toward but short of said first and second paths, said breaking up step comprising dividing said at least one third flow into said partial flows within said third path close to said first and second paths.

4. The method of claim 1, further comprising the steps of merging said first partial flow with said second flows not later than in said first path and merging said second partial flow with said first flows not later than in said second path.

5. Apparatus for simultaneously making two continuous tobacco streams, comprising two conveyors defining first and second elongated paths for advancement of the two streams in a first direction; a duct defining a third path for advancement of a main tobacco flow along a third path in a second direction transversely of said first direction, said duct having sidewalls flanking said third path in said first direction; means for conveying the main flow in said second direction; means for dividing said main flow in said duct into first and second flows and at least one third flow and for diverting said first and second flows into said second and first paths, respectively; and means for breaking up said at least one third flow into first and second partial flows and for directing said first and second partial flows into said first and second paths, respectively.

6. The apparatus of claim 5, wherein said conveyors are foraminous conveyors and said conveying means comprises means for attracting said main flow toward said foraminous conveyors.

7. The apparatus of claim 6, wherein said dividing means comprises first ramps provided on one of said sidewalls and sloping in said second direction toward the other of said sidewalls, and second ramps provided on said other sidewall and sloping in said second direction toward said one sidewall.

8. The apparatus of claim 7, wherein said first ramps alternate with said second ramps in said first direction.

9. The apparatus of claim 8, wherein said means for breaking up said at least one third flow includes a partition disposed between said conveyors intermediate said sidewalls and extending in said first direction.

10. The apparatus of claim 9, wherein said sidewalls include confronting portions flanking a plurality of portions of said third path and defining substantially straight passages for advancement of a plurality of third flows toward and against said partition.

11. The apparatus of claim 10, wherein the combined width of said first ramps in said first direction is a multiple of the combined width of said portions of said one sidewall and the combined width of said second ramps in said first direction is a multiple of the combined width of said portions of said other sidewall.

12. The apparatus of claim 9, wherein aid partition has a substantially convex face confronting said ramps.

13. The apparatus of claim 9, wherein at least one of said sidewalls has at least one air discharging outlet port at said partition.

14. The apparatus of claim 13, wherein each of said sidewalls has at least one air discharging outlet port and said first ramps slope toward the at least one outlet port of said other sidewall, said second ramps sloping toward the at least one outlet port of said one sidewall.

15. The apparatus of claim 13, wherein each of said sidewalls has at least one air discharging outlet port, the at least one outlet port of said one sidewall being located between said partition and said second ramps and the at least one outlet port of said other sidewall being located between said partition and said first ramps.

16. The apparatus of claim 7, wherein at least some of said ramps have tobacco guiding portions extending substantially in said second direction.

* * * * *